United States Patent [19]

Ohta et al.

[11] Patent Number: 5,059,142

[45] Date of Patent: Oct. 22, 1991

[54] ELECTRIC CONNECTOR WITH A TERMINAL CONDUCTOR DETAINING MECHANISM

[75] Inventors: Yukio Ohta; Hiroshi Watanabe; Hideki Ohsumi; Naoto Taguchi, all of Shizuoka, Japan

[73] Assignee: Yazaki Corporation, Tokyo, Japan

[21] Appl. No.: 633,921

[22] Filed: Dec. 26, 1990

[30] Foreign Application Priority Data

Dec. 27, 1989 [JP] Japan ..... 1-336392

[51] Int. Cl.[5] ..... H01R 13/436

[52] U.S. Cl. ..... 439/752

[58] Field of Search ..... 439/595, 752

[56] References Cited

U.S. PATENT DOCUMENTS

| | | | |
|---|---|---|---|
| 4,583,805 | 4/1986 | Mantlik | 339/61 R |
| 4,758,182 | 7/1988 | Anbo et al. | 439/592 |
| 4,826,452 | 5/1989 | Sian et al. | 439/595 |
| 4,921,448 | 5/1990 | Endo et al. | 439/595 |
| 4,946,398 | 8/1990 | Takenouchi et al. | 439/752 |

*Primary Examiner*—Gary F. Paumen

*Attorney, Agent, or Firm*—Armstrong, Nikaido, Marmelstein, Kubovcik & Murray

[57] ABSTRACT

An electric connector with a terminal conductor detaining mechanism for restraining terminal conductors from slipping out of the electric connector. The electric connector comprises: a connector shell having a plurality of terminal chambers and provided with a pair of flexible, temporary locking strips and with a pair of main locking parts; and a terminal conductor detaining member provided with a plurality of terminal conductor detaining fingers and a pair of flexible locking arms. The terminal conductor detaining member is combined temporarily with the connector shell with the fexible locking arms thereof engaging the flexible locking strips of the connector shell, respectively, to keep the connector shell and the terminal conductor detaining member in a temporarily combined state. The terminal conductor detaining member is combined completely with the connector shell by pressing the terminal conductor detaining member into the connector shell so that the locking arms engage the main locking parts of the connector shell, respectively. In pressing the terminal conductor detaining member into the connector shell to combine the terminal conductor detaining member and the connector shell in a completely combined state, the flexible locking strips must be pressed forcibly to allow the terminal conductor detaining member to move further into the connector shell. Thus, the accidental complete combination of the terminal conductor detaining member and the connector shell is prevented.

5 Claims, 5 Drawing Sheets

ELECTRIC CONNECTOR WITH A TERMINAL CONDUCTOR DETAINING MECHANISM

BACKGROUND OF THE INVENTION

1. Field of the Invention

The present invention relates to an electric connector for electrically and mechanically connecting wiring harnesses, having a connector shell provided with a terminal conductor detaining mechanism for restraining terminal conductors from slipping out of the connector shell.

2. Description of the Prior Art

An electric connector, in general, has a connector shell provided with a terminal conductor detaining mechanism for detaining terminal conductors inserted in the terminal chamber of the connector shell to restrain the terminal conductors from slipping out of the terminal chamber. Such a terminal conductor detaining mechanism comprises flexible detaining members formed integrally with the connector shell on the inner surface of the connector shell within the terminal chamber so as to engage terminal conductors inserted in the terminal chamber to restrain the terminal conductors from slipping out of the terminal chamber. A recently proposed electric connector incorporates a terminal conductor detaining mechanism comprising a terminal detaining member inserted in the connector shell of the electric connector from behind the connector shell to restrain terminal conductors inserted in a terminal chamber formed in the connector shell in cooperation with or instead of the flexible detaining members formed on the inner surface of the connector shell.

FIGS. 8 and 9 show a conventional electric connector provided with such a terminal conductor detaining mechanism. Auxiliary stoppers b are formed on the outer surface of a connector shell a near the rear end of the same, and main stoppers c are formed on the outer surface of a connector shell a in front of the auxiliary stoppers b. A terminal detaining member d having catching tongues e is put on the rear portion of the connector shell a with the catching tongues e in engagement with the auxiliary stoppers b to connect the terminal detaining member d temporarily to the connector shell a. Then, terminal conductors g connected to the extremities of wires are inserted through the body f of the terminal detaining member d in terminal chambers h formed in the connector shell a as shown in FIG. 8. Terminal detaining tongues i are formed in the inner surface of the body f of the terminal detaining member d. In a state as shown in FIG. 8, in which the terminal detaining member d is connected temporarily to the connector shell a, the terminal detaining tongues i are located outside the passage of the terminal conductors g. Then, as shown in FIG. 9, the terminal detaining member d is pressed to the front so that the catching tongues e engage the main stoppers c to connect the terminal detaining member d securely to the connector shell a as shown in FIG. 9. In a state shown in FIG. 9, the detaining tongues i are bent toward the terminal conductors g by taper surfaces j formed in the inner surface of the connector shell a so that the tips $i_1$ of the detaining tongues i engage the terminal conductors g to detain the terminal conductors g in place.

This terminal conductor detaining mechanism, however, has a disadvantage that the terminal detaining member d temporarily connected to the connector shell a may be pressed accidentally to its locking position on the connector shell a by an external force and the detaining member d may be connected firmly to the connector shell a before the terminal conductors g are inserted in the terminal chambers h.

SUMMARY OF THE INVENTION

The present invention has been made in view of such a disadvantage of the conventional terminal conductor detaining mechanism and it is therefore an object of the present invention to provide an electric connector with a terminal conductor detaining mechanism, capable of preventing the accidental movement of a detaining member temporarily connected to a connector shell to its locking position and capable of moving the detaining member to its locking position by a single locking stroke.

In one aspect of the present invention, an electric connector with a terminal conductor detaining mechanism comprises a connector shell provided with terminal chambers, and a detaining member having terminal detaining tongues to be inserted in the terminal chambers and capable of being put on the rear end of the connector shell at both a temporarily connected position where flexible detaining arms formed on the detaining member engage flexible stoppers formed on the connector shell, and a locking position to which the flexible detaining arms are guided by the flexible stoppers.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

Figure 1:
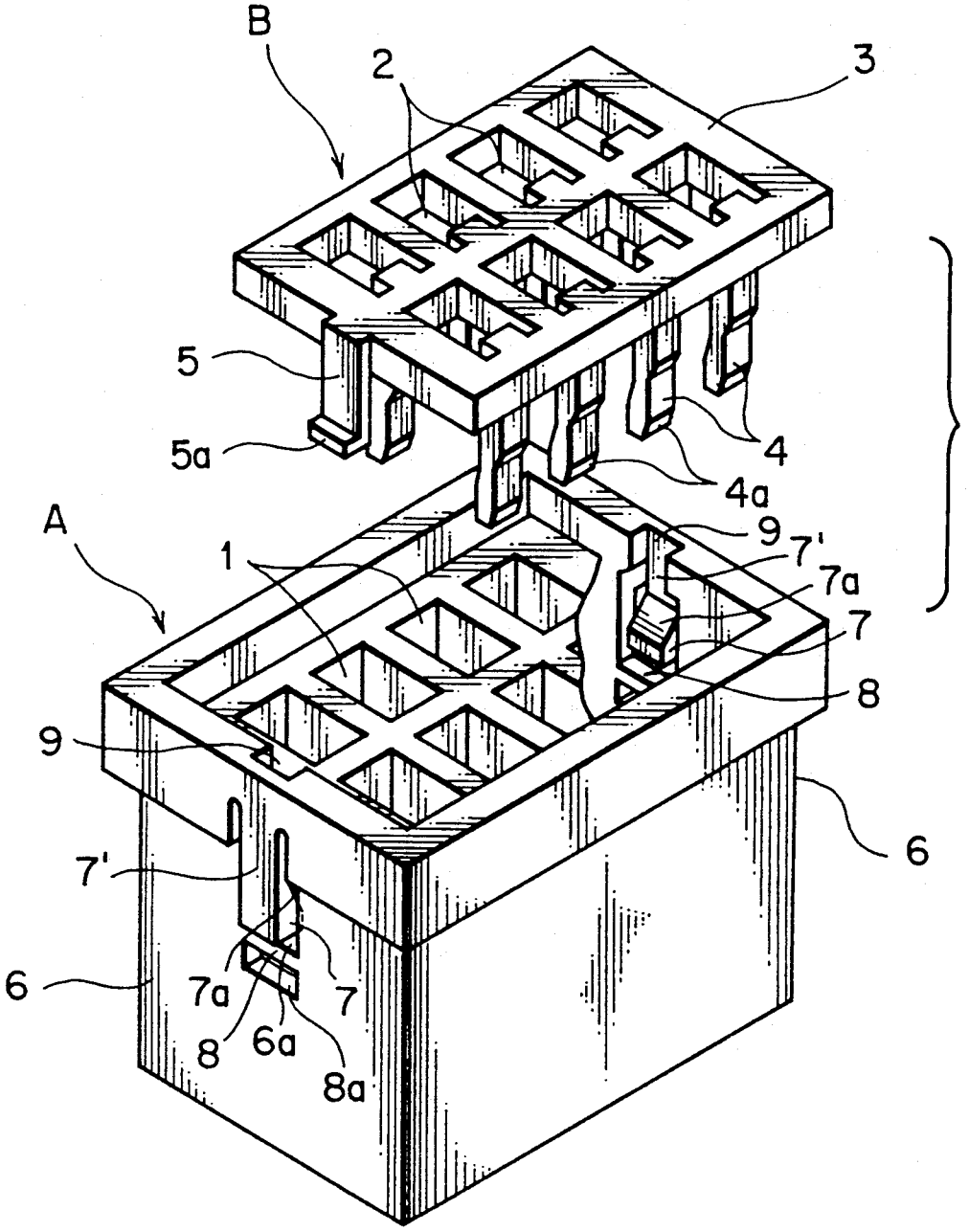
FIG. 1 is an exploded perspective view of an electric connector with a terminal conductor detaining mechanism in a preferred embodiment according to the present invention.

An electric connector with a terminal conductor detaining mechanism in a preferred embodiment according to the present invention will be described hereinafter with reference to FIGS. 1 to 4. The electric connector comprises a connector shell A formed by molding a synthetic resin and a terminal conductor detaining member B formed by molding a synthetic resin. The connector shell A is provided with a plurality of elongate terminal chambers 1 and a flexible detaining tongue 13 formed in each terminal chamber 1 to detain a terminal conductor C secondarily in the terminal chamber 1. The terminal conductor detaining member B has a base frame 3 provided with a plurality of terminal conductor receiving holes 2 corresponding respectively to the elongate terminal chambers 1, a plurality of flexible terminal conductor detaining fingers 4 extending from the base frame 3 so as to be inserted respectively in the terminal chambers 1, and a pair of flexible locking arms 5 formed on the opposite sides of the base frame 3 so as to engage the connector shell A. The extremity of each flexible locking arm 5 is bent outward to form a locking projection 5*a*.

Temporary locking projections 7 and main locking projections 8 are formed in that order on the inner surfaces of the opposite side walls 6 of the connector shell A. Each temporary locking projection 7 is formed so as to project inward from the extremity of a flexible strip 7′ formed by a substantially channel shaped slit 6*a* in the side wall 6 such that said flexible strip 7′ has a forward free end. A guide slope 7*a* is formed on the inner rearward surface of the flexible strip 7′ so as to extend behind the temporary locking projection 7. Each main locking projection 8 projects from the inner surface of the side wall 6 by a distance substantially equal to that of projection of the temporary locking projection 7. A space S capable of receiving the locking projection 5*a* of the flexible locking arm 5 is formed between the main locking projection 8 and the temporary locking projection 7. Apertures 8*a* are formed in front of the main locking projections 8, respectively, for observation.

Figure 2A:
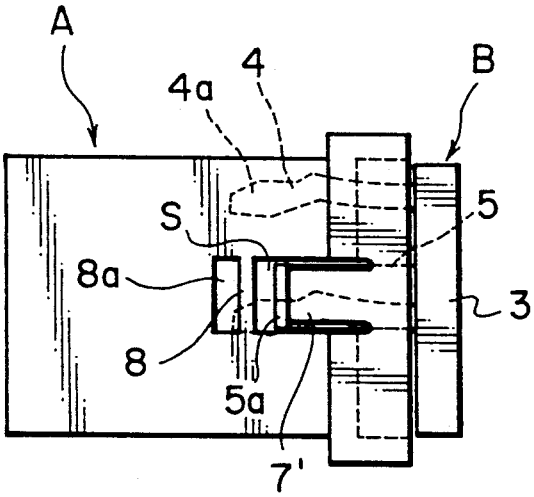
FIGS. 2(*a*) and 2(*b*) are a side elevation and a longitudinal sectional view, respectively, of the electric connector with a terminal conductor detaining mechanism of FIG. 1 in a temporarily assembled state.
Figure 2B:
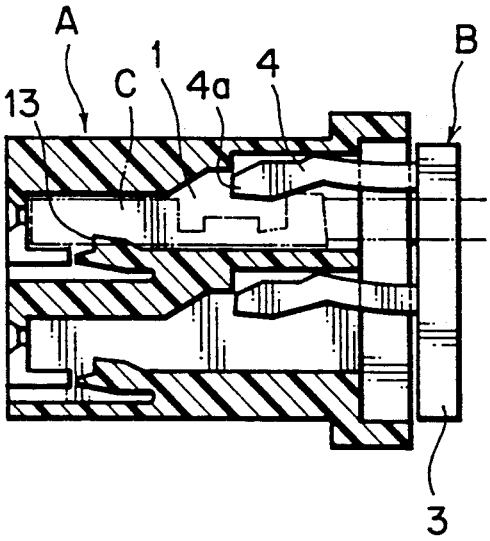

In combining the connector shell A and the terminal conductor detaining member B, the terminal conductor detaining member B is inserted in the connector shell A sliding the flexible locking arms 5 of the terminal conductor detaining member B along guide grooves 9 formed in the inner surfaces of the side walls 6 guide grooves 9 being substantially parallel to terminal chambers 1. As the flexible locking arms 5 slide along the guide grooves 9, the locking projections 5*a* slides along the guide slopes 7*a* and hence the flexible locking arms 5 are bent flexibly inward and, eventually, the locking projections 5*a* engage the temporary locking projections 7, respectively, for temporary lock as shown in FIGS. 2(*a*) and 4(*a*). The electric connector thus temporarily assembled is delivered to a wiring harness fabricating shop. The engagement of the flexible locking arms 5 of the terminal conductor detaining member B and the guide grooves 9 of the connector shell A restrains the terminal conductor detaining member B from rattling during transportation.

Figure 3A:
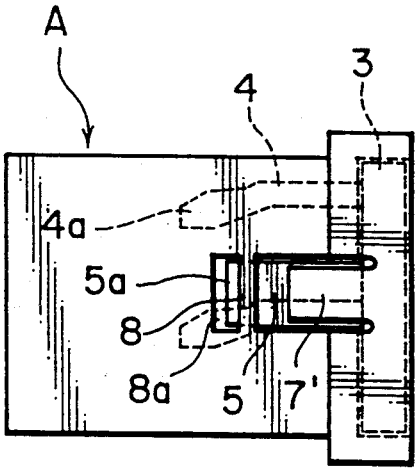
FIGS. 3(*a*) and 3(*b*) are a side elevation and a longitudinal sectional view, respectively, of the electric connector with a terminal conductor detaining mechanism of FIG. 1 in a completely assembled state.
Figure 3B:
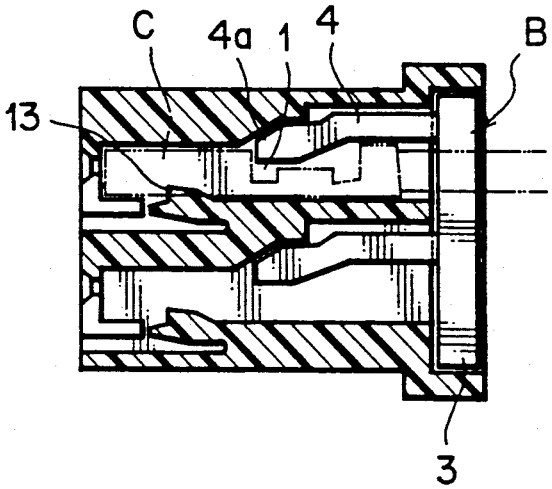
Figure 4A:
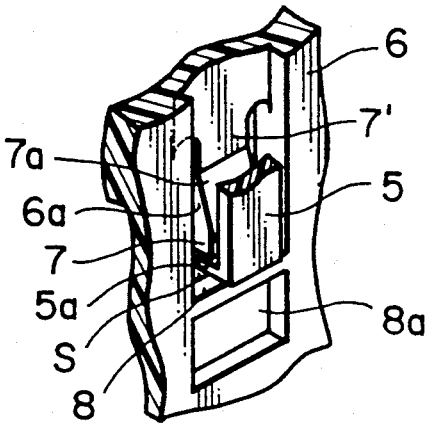
FIGS. 4(*a*) and 4(*b*) are perspective views of an essential portion of the electric connector with a terminal conductor detaining mechanism in a temporarily assembled state and in a completely assembled state, respectively.
Figure 4B:
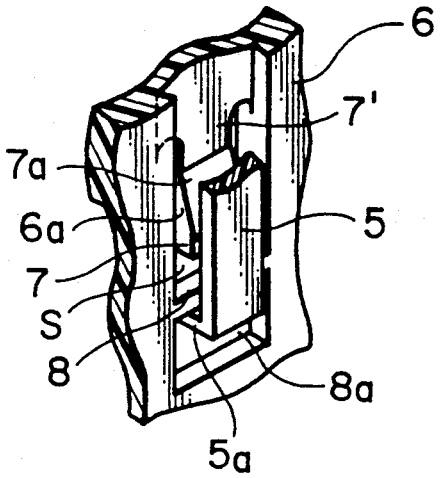

Then, the terminal conductors C are inserted through the terminal receiving holes 2 of the terminal conductor detaining member B in the terminal chambers 1 of the connector shell A so that the terminal conductors C are held in place by the detaining tongues 13. As each terminal conductor C is inserted in the terminal chamber 1, the terminal conductor C shifts the tip 4*a* of the corresponding terminal conductor detaining finger 4, and the tip 4*a* of the terminal conductor detaining finger 4 is restored to its original position after the terminal conductor C has been located in place. The pair of flexible strips 7′ are pressed inward to bend the flexible locking arms 5 inward so that the locking projections 5*a* are shifted inwardly of the main locking projections 8, and then the base frame 3 is pressed to advance the flexible locking arms 5 so that the locking projections 5*a* override the corresponding main locking projections 8 for final lock as shown in FIGS. 3(*b*) and 4(*b*). In this state, the tips of the terminal conductor detaining fingers 4 engage the corresponding terminal conductors C to detain the terminal conductors C in place.

Figure 5:
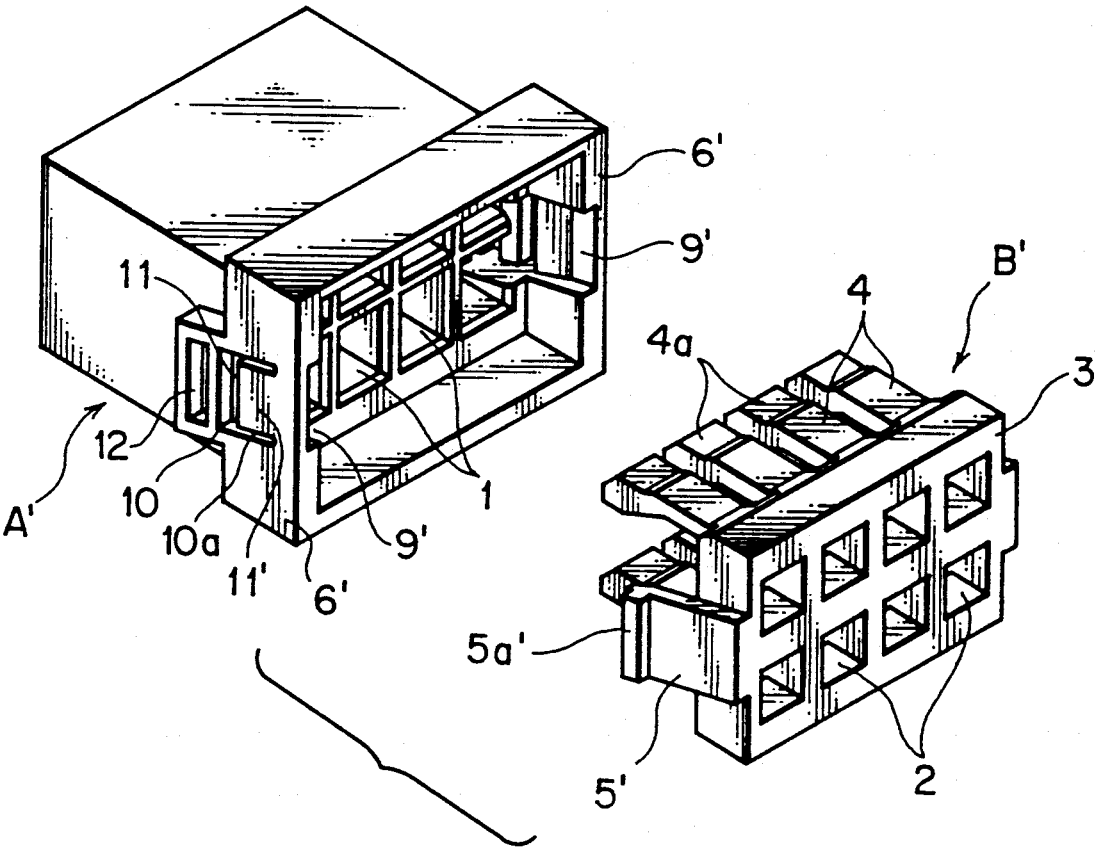
FIG. 5 is an exploded perspective view of an electric connector with a terminal conductor detaining mechanism in another embodiment according to the present invention.
Figure 6A:
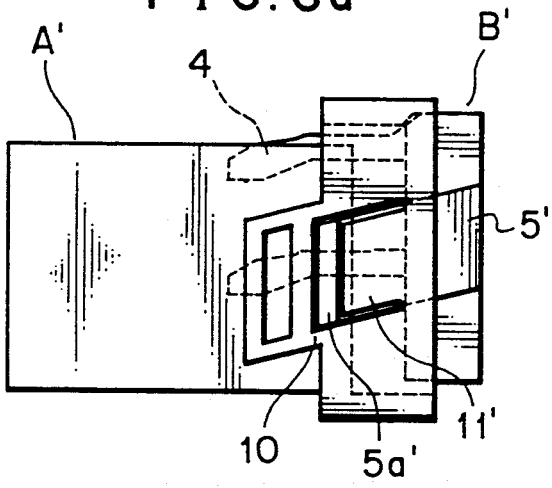
FIGS. 6(*a*), 6(*b*) and 6(*c*) are a side elevation, a longitudinal sectional view and a fragmentary cross sectional view, respectively, of the electric connector with a terminal conductor detaining mechanism of FIG. 5 in a temporarily assembled state.
Figure 7A:
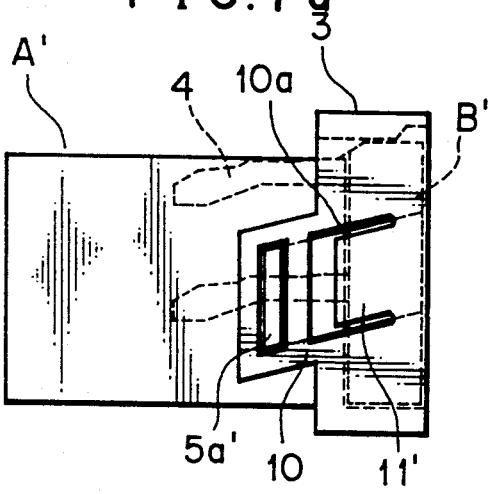
FIGS. 7(*a*), 7(*b*) and 7(*c*) are a side elevation, a longitudinal sectional view and a fragmentary cross sectional view, respectively, of the electric connector with a terminal conductor detaining mechanism of FIG. 5 in a completely assembled state.
Figure 6B:
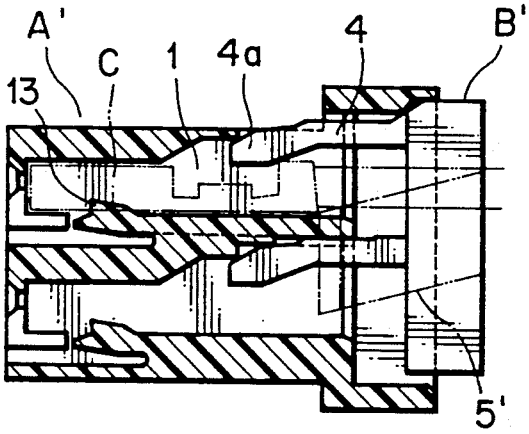
Figure 7B:
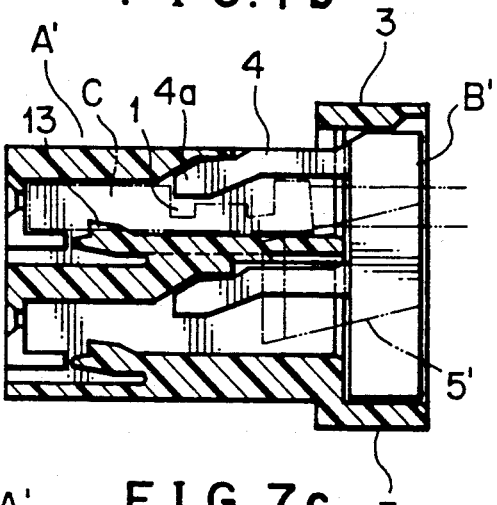
Figure 6C:
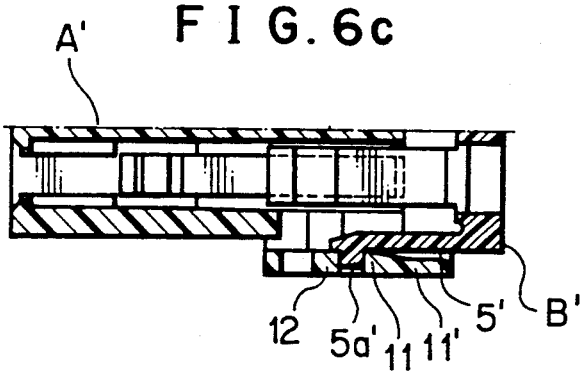
Figure 7C:
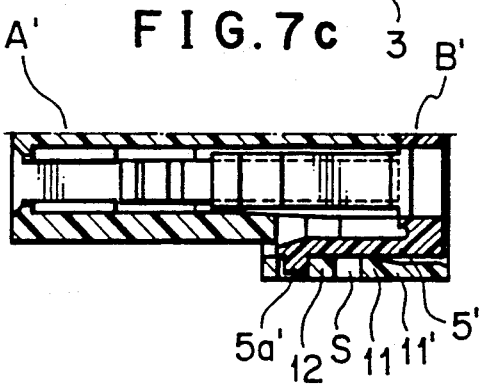
Figure 8:
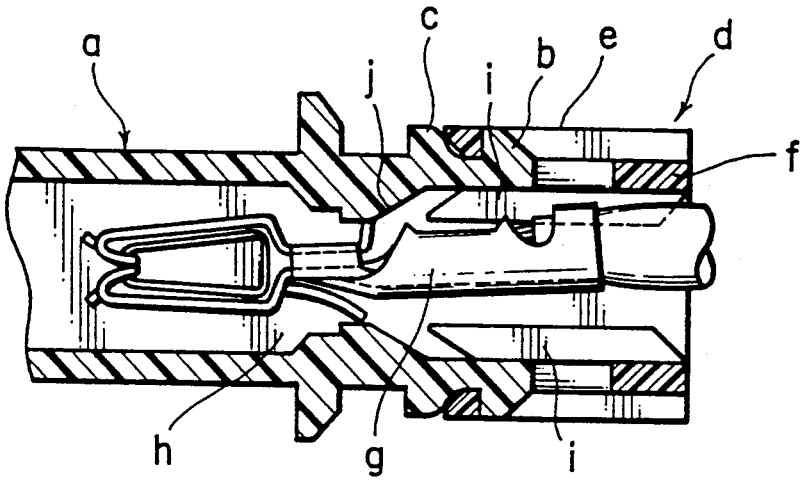
FIG. 8 is a longitudinal sectional view of a conventional electric connector with a terminal conductor detaining mechanism in a temporarily assembled state.
Figure 9:
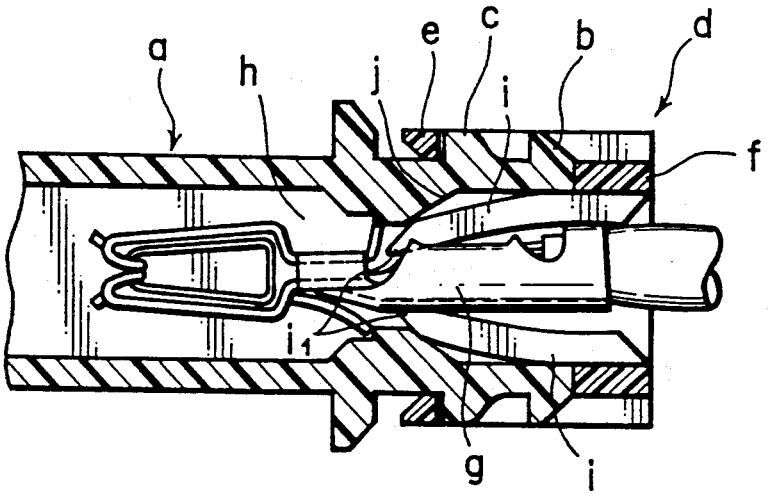
FIG. 9 is a longitudinal sectional view of the conventional electric connector with a terminal conductor detaining mechanism of FIG. 8 in a completely assembled state.

FIGS. 5 to 7 shows an electric connector with a terminal conductor detaining mechanism in a second embodiment according to the present invention, in which parts like or corresponding to those of the first embodiment shown in FIGS. 1 to 4 are denoted by the same reference characters and the description thereof will be omitted to avoid duplication.

Referring to FIGS. 5 to 7, a terminal conductor detaining member B′ is provided with inclined flexible locking arms 5′ inclined at an angle to the direction of insertion of the terminal conductor detaining member B′ in a connector shell A′, namely, the elongate terminal chambers 1, and the connector shell A′ is provided in the inner surfaces of the opposite side walls 6′ thereof with guide grooves 9′ inclined at an angle corresponding to that of the flexible locking arms 5′.

The connector shell A′ has a frame 10 at its rear end. Slits 10*a* are formed in the opposite side walls of the frame 10 to form flexible strip 11′ each having a temporary locking edge 11 at its extremity. A main locking part 12 is formed on the front extension of each side wall of the frame 10 with a space S between the temporary locking edge 11 and the main locking part 12.

When the connector shell A′ and the terminal conductor detaining member B′ are locked temporarily as shown in FIGS. 6(*a*), 6(*b*) and 6(*c*), the tip 4*a* of each terminal detaining finger 4 is kept clear of the passage of the terminal conductor C and hence the terminal conductor C can be inserted in the terminal chamber 1 without touching the terminal conductor detaining finger 4. The terminal conductor C is detained by the flexible detaining tongue 13 in the terminal chamber 1.

Then, the terminal conductor detaining member B′ is pressed into the frame 10 of the connector shell A′ by pressing the flexible strips 11′ inward to bend the flexible locking arms 5′ inward. Consequently, the flexible locking arms 5′ slides downward toward the front, as viewed in FIG. 7(*a*), along the guide grooves 9′ and, eventually, the locking projections 5*a*′ of the flexible locking arms 5′ engage the main locking parts 12 to lock the connector shell A′ and the terminal conductor detaining member B′ completely and finally. In this state, the tips 4*a* of the flexible terminal conductor detaining fingers 4 engage the corresponding terminal conductors C to detain the same in place as shown in FIG. 7(*b*).

Since the flexible strips (7', 11') must be pressed forcibly inward in completely combining the connector shell and the terminal conductor detaining member, the terminal conductor detaining member temporarily combined with the connector shell is never moved accidentally into the connector shell by an external force. The connector shell and the terminal conductor detaining member can be completely combined by simply pressing the terminal conductor detaining member into the connector shell, pressing the flexible strips inward.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. An electric connector with a terminal conductor detaining mechanism, comprising:

a connector shell having a plurality of elongate terminal chambers and provided with provisional locking means and final locking means inwardly forwardly of said provisional locking means in said connector shell;

a terminal conductor detaining member provided with a plurality of terminal conductor detaining fingers to be received respectively in the terminal chambers of the connector shell when the terminal conductor detaining member is combined with the connector shell, said terminal conductor detaining member having at least one flexible locking arm to be temporarily arrested by said provisional locking means, said provisional locking means being flexible and capable, when pressed, of deforming said at least one flexible locking arm inwardly to override and snap outwardly past said final locking means while the terminal conductor detaining member is pressed forwardly into the connector shell such that said connector shell and said terminal conductor detaining member are finally locked.

2. An electric connector according to claim 1, wherein said provisional locking means includes a pair of flexible locking strips each formed by a channel-shaped slit in said connector shell to have a forward free end, each flexible locking strip having a temporary locking projection, said temporary locking projection having a guide slope formed on an inner rearward surface of the flexible strip.

3. An electric connector according to claim 2, wherein said final locking means includes a main locking projection formed forwardly of said each flexible locking strip.

4. An electric connector according to claim 1, wherein said connector shell has guide groove means formed on an inner wall thereof to receive said at least one flexible locking arm therein, said guide groove means extending substantially parallel to said elongate terminal chambers.

5. An electric connector according to claim 1, wherein said connector shell has guide groove means formed in an inner wall thereof to receive said at least one flexible locking arm therein, said guide groove means extending at an angle to said elongate terminal chambers such that said conductor detaining fingers of said terminal conductor detaining member are kept clear of passages of terminal conductors when said terminal conductor detaining member and said connector shell are temporarily locked whereas said conductor detaining fingers of said terminal conductor detaining member engage corresponding terminal conductors to detain the corresponding terminal conductors when said terminal conductor detaining member and said connector shell are finally locked.

* * * * *